United States Patent [19]

Mörz

[11] 4,356,495

[45] Oct. 26, 1982

[54] CORRUGATED ANTENNA FEEDHORN WITH ELLIPTICAL APERTURE

[75] Inventor: Günter Mörz, Ludwigsburg, Fed. Rep. of Germany

[73] Assignee: Licentia Patent-Verwaltungs-GmbH, Frankfurt am Main, Fed. Rep. of Germany

[21] Appl. No.: 191,745

[22] Filed: Sep. 29, 1980

[30] Foreign Application Priority Data

Sep. 29, 1979 [DE] Fed. Rep. of Germany ..... 2939562

[51] Int. Cl.[3] ..... H01Q 13/02

[52] U.S. Cl. ..... 343/786

[58] Field of Search ..... 343/786, 840, 854

[56] References Cited

U.S. PATENT DOCUMENTS 3,623,115 11/1971 Schuttloffel et al. ..... 343/781

4,077,039 2/1978 Rem et al. ..... 343/786

4,295,142 10/1981 Thiere et al. ..... 343/786

FOREIGN PATENT DOCUMENTS 2616125 5/1979 Fed. Rep. of Germany .

*Primary Examiner*—Eli Lieberman

*Attorney, Agent, or Firm*—Spencer & Kaye

[57] ABSTRACT

An antenna feedhorn comprising a transition waveguide for matching the cross section of the feeder line to the cross section of a subsequent hybrid mode exciting section followed by a horn section with an elliptical aperture, and with the hybrid mode exciting section and the horn section each being provided with a corrugated structure. The hybrid mode exciting section has a circular cross section and the horn section has a cross section which steadily widens from the circular cross section of the hybrid mode exciting section to the elliptical cross section of the horn aperture.

1 Claim, 2 Drawing Figures

CORRUGATED ANTENNA FEEDHORN WITH ELLIPTICAL APERTURE

BACKGROUND OF THE INVENTION

The present invention relates to a corrugated antenna feedhorn including a transition waveguide for matching the cross section of the feeder line to the cross section of a subsequent hybrid mode exciting section which is followed by a horn section having an elliptical aperture, the hybrid mode exciting section and the horn section being provided with a corrugated structure.

Antenna feedhorns with elliptical aperture are used where an elliptical radiation field is to be generated, for example, when geographically defined areas are to be supplied with television programs via satellites.

Generally corrugated antenna feedhorns consist of three sections, a transition section for cross-sectional matching with the feeder waveguide, a waveguide section in which the hybrid modes are excited, and a horn whose aperture is designed in such a way that the radiation field will have the desired shape, the hybrid mode exciting section and the horn section being provided with a corrugated structure. Such an arrangement is disclosed, for example, in German Auslegeschrift (Published Patent Application No. 2,616,125) published May 3rd, 1979. However, in the arrangement disclosed in this application, the hybrid mode exciting section and the following horn section have the same cross-sectional configuration, i.e., both are, for example, rectangular, or circular or noncircular. Thus, with a horn section having an elliptical, i.e., noncircular cross section, the hybrid mode exciting section also has an elliptical cross section. It depends mainly on the configuration of the hybrid mode exciting section how well the requirements for broadbandedness, low crosspolarization level and identical lobe width in the E and H plane of the radiation field are met.

When transmitting circularly polarized fields, noncircular, e.g. elliptical, antenna feedhorns generate phase shifts between the two polarization planes or different hybrid modes in both planes. A transmission of precisely circularly polarized fields is impossible for that reason, so that the circular polarization changes to an elliptical polarization.

SUMMARY OF THE INVENTION

It is therefore the object of the present invention to provide a corrugated antenna feedhorn with an elliptical cross section which generates a circularly polarized radiation field in a manner so as to greatly reduce (the occurrence of) a phase shift between the polarization planes.

This is accomplished by the present invention in that in an antenna feedhorn including a transition waveguide for matching the cross section of a feeder line to the cross section of a following hybrid mode exciting section which in turn is followed by a horn section having an elliptical aperture, and with the hybrid mode exciting section and the horn section each being provided with a corrugated structure, the hybrid mode exciting section has a circular cross section and the horn section steadily and smoothly widens from the circular cross section of the hybrid mode exciting section to the elliptical cross section of the horn aperture.

DETAILED DESCRIPTION OF THE PREFERRED EMBODIMENTS

Figure 1:
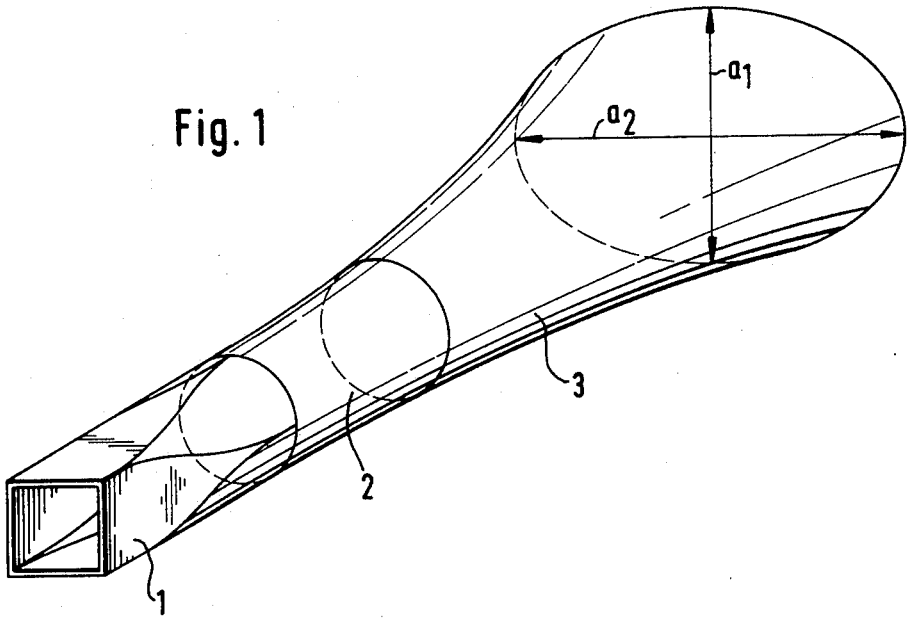
FIG. 1 is a perspective view of an antenna feedhorn according to the invention.

The antenna feedhorn according to the invention shown perspectively in FIG. 1 comprises three waveguide sections arranged one behind the other, namely a transition waveguide section 1, a hybrid mode exciting section 2 and a horn section 3 having an elliptical aperture. The transition waveguide section 1 serves to match the square cross section as illustrated of the feeder waveguide (not shown) to be used with the feedhorn to the circular cross section of the hybrid mode exciting section 2. The hybrid mode exciting section 2, whose circular cross section in this embodiment is slightly widened toward the output, is followed by the horn section 3 without a sudden or abrupt change in cross section. The cross section of the horn section 3 begins with a circular cross section, which is matched to the output of the hybrid mode exciting section 2, and steadily widens to different degrees in two mutually perpendicular planes so that the circular cross section changes to an elliptical cross section. This widening zone with variable axial ratio of the cross sectional ellipse may extend over the entire length of the horn section 3, i.e., from the section 2 to the horn aperture, as shown in the illustrated embodiment or may cover only part of the entire length of horn section 3.

Figure 2:
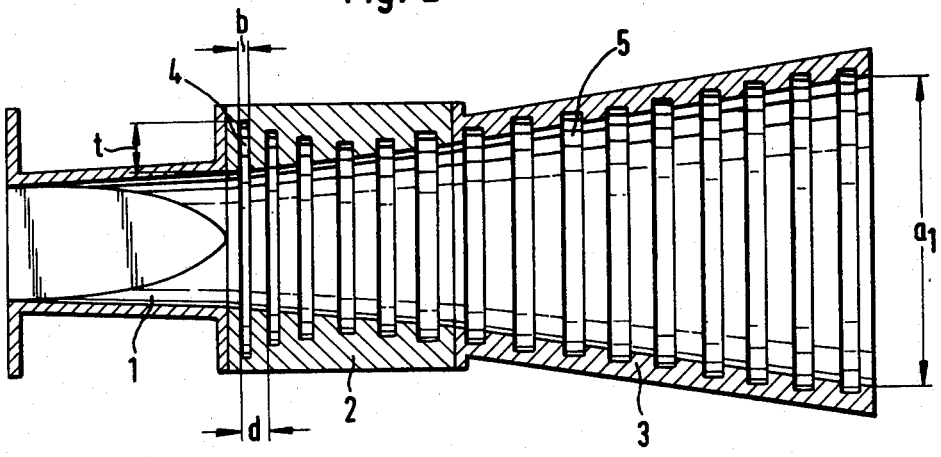
FIG. 2 is a longitudinal sectional view of the antenna feedhorn of FIG. 1.

FIG. 2 shows a longitudinal section along the plane through the minor axis $a_1$ of the elliptical aperture of the antenna feedhorn shown in FIG. 1. The hybrid mode exciting section 2 includes a corrugated structure. The grooves 4 of this structure change smoothly in their dimensions (distance d, depth t and width b) along the longitudinal axis. According to the state of art (German Auslegeschrift No 2 616 125) the depth t of the grooves changes approximately from a half wavelength at the beginning to a quarter wavelength at the end of the section 2. The distance d between the grooves 4 changes from a smaller value ($\lambda/10$) at the beginning to a larger value ($\lambda/4$) at the end of the section 2. The width b of the grooves 4 changes from a fifth to a half of the distance d between two neighbouring grooves.

The grooves 5 of the corrugates structure of the horn section 3 have—as shown in FIG. 2—all the same dimensions (distance, depth and width) beginning at the end of the hybrid mode exciting section 2.

Normally the grooves 4 and 5 of the two sections 2 and 3 have the same depth t in both mutually perpendicular planes through the minor axis $a_1$ and the major axis $a_2$ of the elliptical horn aperture. But it is possible to design the groove depth t slightly differently in the two mutually perpendicular planes in order to equalize the propagation behaviour of the hybrid modes in the two planes.

For instance a corrugated antenna feedhorn for the 12 GHz frequency band (11.7–12.5 GHz) has the following dimensions:

| | |
|---|---|
| length of the whole arrangement | 400 mm |
| cross section of the square transition waveguide section 1 | 20 × 20 mm |

-continued

| | |
|---|---|
| cross section of the hybrid mode exciting section 2 at the interface to the section 1 | 28.28 mm $\phi$ |
| length of the minor axis $a_1$ and of the major axis $a_2$ of the elliptical horn aperture | $a_1$ = 50 mm<br>$a_2$ = 150 mm |

By using a hybrid mode exciting section 2 with circular cross section and a subsequent steady change to the elliptical cross section of the aperture of the horn section 3, the hybrid modes are excited uniformly in both polarization planes without any shift in phase. Thus, the antenna feedhorn according to the present invention provides very good conditions for the generation of a circularly polarized radiation field with an elliptical cross section. The circular polarization can be generated in a polarization converter which is either connected ahead of the transition waveguide section 1 or may be integrated in that transition waveguide section.

It is to be understood that the above description of the present invention is susceptible to various modifications, changes and adaptations, and the same are intended to be comprehended within the meaning and range of equivalents of the appended claim.

What is claimed is:

1. In an antenna feedhorn including a transition waveguide for matching the cross section of the feeder line to the cross section of a following hybrid mode exciting section which in turn is followed by a horn section having an elliptical aperture, said hybrid mode exciting section and said horn section each being provided with a corrugated structure; the improvement wherein said hybrid mode exciting section has a circular cross section, and said horn section has a cross section which steadily and smoothly widens from said circular cross section of said hybrid mode exciting section to the elliptical cross section of said aperture.

* * * * *